United States Patent [19]

Van der Heijden

[11] 4,068,782

[45] Jan. 17, 1978

[54] GLADE OVERCAP FOR TILT VALVE

[75] Inventor: Johannes Van der Heijden, Nieuwkoop, Netherlands

[73] Assignee: S. C. Johnson & Son Inc., Racine, Wis.

[21] Appl. No.: 653,331

[22] Filed: Jan. 29, 1976

[30] Foreign Application Priority Data

Oct. 23, 1975 Canada ..... 238204

[51] Int. Cl.[2] ..... B65D 83/14

[52] U.S. Cl. ..... 222/402.13; 222/402.15

[58] Field of Search ..... 222/402.13, 402.15, 222/402.21, 402.22, 402.23, 174

[56] References Cited

U.S. PATENT DOCUMENTS

| | | | |
|---|---|---|---|
| 3,149,761 | 9/1964 | Harris et al. | 222/402.13 X |
| 3,212,680 | 10/1965 | Crowell et al. | 222/402.13 |
| 3,313,458 | 4/1967 | Braun | 222/402.13 |
| 3,329,320 | 7/1967 | Braun | 222/402.13 |
| 3,583,607 | 6/1971 | Beck | 222/402.21 |
| 3,648,905 | 3/1972 | Kauder | 222/402.13 X |
| 3,692,215 | 9/1972 | Nigro | 222/402.13 |
| 3,854,632 | 12/1974 | Smrt | 222/402.15 X |
| 4,013,231 | 3/1977 | Van Veldhoven | 222/402.15 X |

*Primary Examiner*—Robert B. Reeves
*Assistant Examiner*—Charles A. Marmor

[57] ABSTRACT

A valve actuating device for use with pressurized aerosol containers of the type having tilt actuatable valves. The device includes an actuator-overcap which defines an access opening for a tiltable valve stem and has a main portion adjacent the container and a finger-depressible tab portion hinged at one end to the main portion and having its other end adjacent the stem such that the stem is tilted thereby when the tab is depressed in a direction along the stem axis. In certain preferred embodiments, the valve stem includes a spray member and the access opening is defined within the tab portion.

10 Claims, 4 Drawing Figures

GLADE OVERCAP FOR TILT VALVE

BACKGROUND OF THE INVENTION

This invention relates in general to pressurized dispensing and in particular to actuators for tilt valves used in aerosol containers.

A wide variety of actuating devices have been used in aerosol dispensers having tilt actuated valves. Examples are: devices in which direct finger pressure is applied to the valve stem in a direction normal to the stem, such as the devices shown in U.S. Pat. Nos. 2,615,597 and 2,992,760; devices having a trigger piece fixedly attached to the valve stem and designed to be laterally displaced to tilt the stem, such as the device shown in U.S. Pat. No. 3,583,607; devices in which a trigger piece is arranged to be laterally displaced to contact and laterally displace the valve stem, such as the device shown in U.S. Pat. No. 3,236,421; and extension devices fixedly attached to the valve stem and providing a depression point laterally offset from the stem whereby the stem tilts toward the point of depression, such as devices shown in U.S. Pat. No. 3,330,447.

None of these types of tilt actuating devices are at all similar in operation or appearance to the well-known actuator-overcap of the type used with aerosol valves of the type requiring stem depression (as opposed to stem tilting) for actuation. Such actuator-overcaps typically have a main portion which is attached to the pressurized container and a tab or button portion which when axially depressed actuates the aerosol valve. Consumers of aerosol products are well acquainted with this sort of device and can operate it without need for instructions. On the other hand, many actuators for tilt valves are either not well known and/or do not lend themselves to packaging which is aesthetically pleasing or in keeping with traditional package configurations for certain product lines.

This invention provides a unique actuating device for use with pressurized dispensers of the type having tilt actuatable valves. The device of this invention includes a main or overcap portion adjacent the pressurized container and a finger-depressible tab or actuator portion hinged at one end to the main portion and having its other end adjacent the valve stem such that the stem may be tilted by the tab portion to actuate the valve when the tab portion is axially depressed. The actuator-overcap device defines an access opening to receive the valve stem. In preferred embodiments the access opening is defined in the tab portion near a free end of the tab portion (that is, the end remote from the hinge). When the access opening is defined in the tab portion, it is aligned with the stem axis when the tab is not depressed and mis-aligned therewith when the tab is depressed, thereby to tilt the valve which is received in or entrapped in the access opening. In preferred embodiments the hinge of tab portion to main portion is at the radial perimeter of the main portion and the distance from the hinge to the free end of the tab portion, in a direction normal to the stem axis, is greater when the tab is depressed than when it is not depressed. In some preferred embodiments the end of the valve stem is recessed within the access opening. If a spray is to be discharged, a spray member having an axially directed spray orifice is attached to and forms part of the valve stem within the access opening, and interacts with the tab portion when it is depressed.

This invention provides a device for actuation of tilt valves which may be easily understood by consumers because of its similarity in operation to the well-known actuator-overcaps used with aerosol valves of the type actuated by axial depression of the valve stem. This invention also provides an actuator-overcap for use with tilt-actuated valves which lends itself to a variety of aesthetically pleasing designs, including designs traditionally used in actuator-overcaps for certain well-known products.

This invention is extraordinarily easy to operate — requiring application of very light finger pressure in comparison with many commonly used valve actuating devices. This benefit is made possible in part by a mechanical advantage derived through the small angle of interacting convergence between the tab portion and the stem. Specifically, the mechanical advantage is inversely proportional to the sin of the angle of convergence of tab with stem and directly proportional to the fraction between 0 and 1 which is representative of the location of the point of force application on the tab. Force is applied somewhere between the hinge and the effective end of the tab portion. If the pressure point is at the effective end, the fraction is 1; if the pressure point is at the hinge, the fraction is 0; if $\frac{2}{3}$ of the way from hinge to effective end, the fraction is $\frac{2}{3}$; etc. Provided, for example, that finger pressure is applied midway between the hinge and the point of contact between tab portion and valve stem, and provided further that the angle of convergence is 15°, a mechanical advantage of about two is obtained, assuming factors such as friction to be negligible. That is, if the axially applied force is X, a force of about 2X is exerted by the tab portion on the valve stem. A greater or lesser advantage could be obtained by changing the pressure point and/or the angle of convergence.

OBJECTS OF THE INVENTION

One object of this invention is to provide an actuator for pressurized containers having tilt actuatable valves which overcomes many of the disadvantages of previously known actuators for tilt valves.

Another object of this invention is to provide an actuator device for tilt valve which may be similar in appearance and in mode of operation to actuator-overcaps of the type commonly used with aerosol valves which require axial depression of the valve stem.

Another object of this invention is to provide an actuator device for use with tilt actuatable valves which is easy to operate.

BRIEF DESCRIPTION OF THE DRAWING

These and other objects will be apparent from the following description of preferred embodiments wherein.

DESCRIPTION OF PREFERRED EMBODIMENTS

Figure 1:
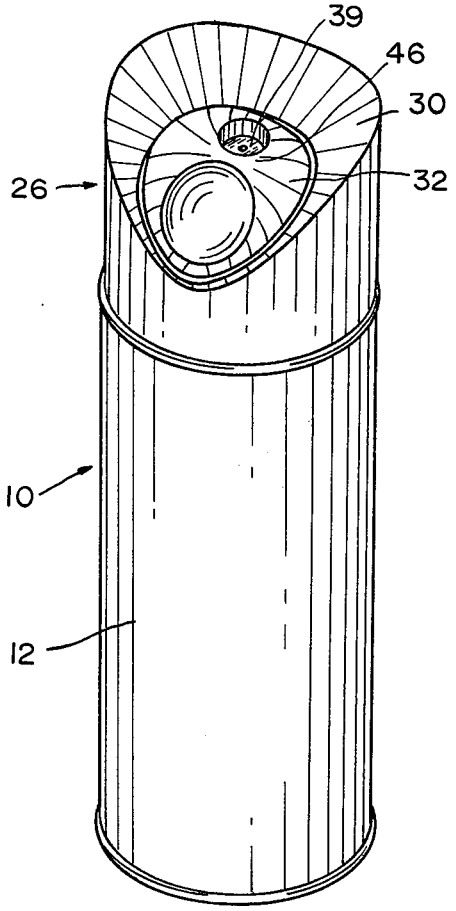
FIG. 1 is a full perspective view of a pressurized container with an actuator device according to this invention.
Figure 3:
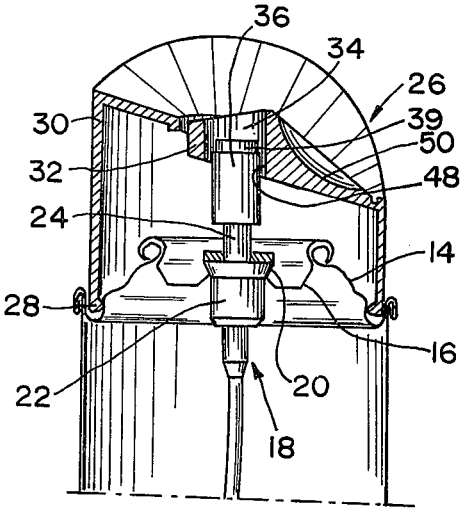
FIG. 3 is a sectional view of a portion of the device, taken along section 3—3 as indicated in FIG. 2.
Figure 4:
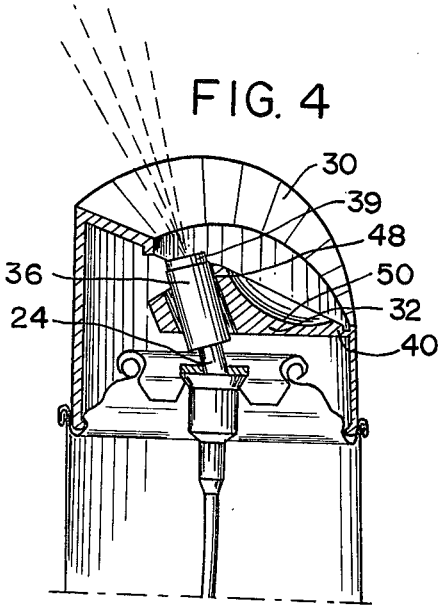
FIG. 4 is a sectional view as in FIG. 3, but showing the device in actuating position.
Figure 2:
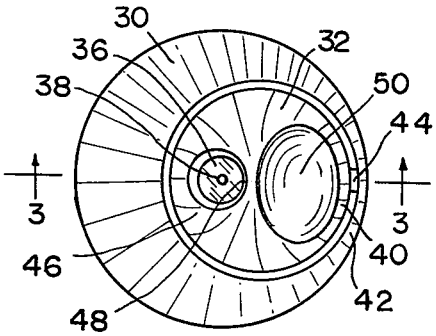
FIG. 2 is a top plan view.

The figures show a pressurized package 10 having a product reservoir portion 12, which is a standard metal container. A dome 14 is seamed to the cylindrical portion of the can body. A valve cup 16 is seamed to dome 14 and has a tilt valve 18 secured thereto by means of a bead 20 which engages the valve body 22. A tiltable valve stem 24 extends from reservoir 12 and is coaxial with the can body. Stem 24 forms an axis line in its undisturbed position, which position is illustrated by FIG. 3. When valve stem 24 is tilted, tilt valve 18 is actuated to emit product from reservoir 12, through stem 24. FIG. 4 illustrates the actuated position of stem 24.

Actuator-overcap 26 is attached to reservoir portion 12 by means of a bead 28 which is engaged with dome 14. Actuator-overcap 26 includes main portion 30, which is attached to reservoir portion 12, and tab portion 32. Actuator-overcap 26 defines an access opening 34 which receives a spray member 36. Spray member 36 forms a part of the tiltable valve stem. In the embodiment illustrated, spray member (or spray tip) 36 is friction fit in fluid-tight relationship to the portion of stem 24 which extends from valve body 22. Spray member 36 forms an axial spray orifice 38 at its terminal end 39. Spray member 36 is cylindrical in shape and is configured to be received freely in access opening 34, which in this embodiment, is defined in tab portion 32.

Tab portion 32 is attached at its first end 40 to the radial perimeter 42 of main portion 30, by means of hinge 44. Main portion 30, tab portion 32 and hinge 44 are preferably integrally molded of plastic materials such as high density polyethylene, polypropylene, polyvinyl chloride, or other materials well known to those skilled in the art. Tab portion 32 has a second end 46 adjacent stem 24. Second end 46 of tab portion 32 has a contact surface 48 which interacts with spray member 36 when tab portion 32 is axially depressed. To actuate the valve the operator exerts downward axial pressure on surface 50. As tab portion 32 is depressed its second end 46, specifically, contact surface 48, tilts valve stem 24 to actuate the valve. This tilting action occurs by virtue of the movement of access opening 34 from a position of axial alignment with stem 24 to a position of axial misalignment therewith, as shown in FIG. 4. As tab portion 32 is moved from its non-actuating position, as shown in FIG. 3, to its actuating position, as shown in FIG. 4, the distance from hinge 44 to contact surface 48, as measured in a direction normal to the axis of stem 24 (when in its non-actuated position), increases, thereby causing the tilting of valve stem 24.

Terminal end 39 of spray member 36 is recessed in access opening 34. This feature protects it from being accidentally tilted during shipping and handling prior to use. Further, the recessing of terminal end 39 may contribute positively to the aesthetic attributes of a pressurized package with which the actuator-overcap is used.

It may readily be appreciated that the actuating device of this invention may easily be assembled with a pressurized container. Spray member 36 may be attached to stem 24 by the valve manufacturer or by the packager. The remaining portion of the actuator device, namely main portion 30 and tab portion 32, may simply be snapped onto the package without any further assembly steps required.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. In a pressurized package of the type having a product reservoir and a tilt-actuatable valve with tiltable valve stem extending from said reservoir and forming an axis line, said stem having a product release orifice substantially at its end, the improvement comprising an actuator-overcap including a main portion adjacent said reservoir and a finger-depressible tab portion hinged at one end to said main portion and having its other end adjacent said stem, said tab portion having a finger-contact surface between said hinged end and said other end, said actuator-overcap defining an access opening for said stem to expose said product release orifice, said opening normally being substantially centered on said axis and being larger than said stem such that said stem is freely received therein as said tab is axially depressed, said opening moving off center with respect to said axis line as said tab is axially depressed such that said stem is tilted by a wedging action of said tab in which said tab moves axially relative to said stem during said depression.

2. The package of claim 1 wherein said tab portion defines said access opening at said other end thereof, said access opening being aligned with said axis when said tab is not depressed and being mis-aligned therewith when said tab is depressed.

3. The package of claim 1 wherein said hinge is near the radial perimeter of said main portion.

4. The package of claim 3 wherein the distance from said hinge to said other end of said tab portion in a direction normal to said axis is greater when said tab is depressed than when it is not depressed.

5. The package of claim 4 wherein said tab portion and said main portion are integrally formed.

6. The package of claim 1 wherein the end of said stem is recessed in said access opening.

7. The package of claim 2 wherein the end of said stem is recessed in said access opening.

8. The package of claim 1 wherein a spray member is attached to said stem within said access opening, said member forming an axial spray orifice at its terminal end.

9. The package of claim 8 wherein said terminal end of said spray member is recessed in said axial opening.

10. The package of claim 9 wherein said tab portion defines said access opening, said access opening being aligned with said axis when said tab is not depressed and being mis-aligned therewith when said tab is depressed.

* * * * *

UNITED STATES PATENT OFFICE

CERTIFICATE OF CORRECTION

Patent No. 4,068,782 Dated January 17, 1978

Inventor(s) Johannes Van der Heijden

It is certified that error appears in the above-identified patent and that said Letters Patent are hereby corrected as shown below:

In the title - delete "GLADE OVERCAP FOR TILT VALVE"

and insert "ACTUATOR-OVERCAP".

Signed and Sealed this

*Twenty-second* Day of *April 1980*

[SEAL]

*Attest:*

SIDNEY A. DIAMOND

*Attesting Officer* *Commissioner of Patents and Trademarks*